United States Patent [19]

Cristofolo

[11] 4,428,477

[45] Jan. 31, 1984

[54] RESEALABLE PACKAGE FOR PREMOISTENED TOWELLETTES

[75] Inventor: Angelo R. Cristofolo, North Brunswick, N.J.

[73] Assignee: Johnson & Johnson Baby Products Company, New Brunswick, N.J.

[21] Appl. No.: 338,462

[22] Filed: Jan. 8, 1982

[51] Int. Cl.[3] ..... B65D 33/16

[52] U.S. Cl. ..... 206/210; 206/812; 206/620; 206/626; 206/632; 383/89; 38/104

[58] Field of Search ..... 206/610, 618, 210, 260, 206/265, 269, 274, 271, 449, 484, 525, 555, 626, 812; 229/62, 64

[56] References Cited

U.S. PATENT DOCUMENTS

| | | | |
|---|---|---|---|
| 2,306,335 | 12/1942 | Feigenbutz | 206/610 |
| 2,687,840 | 8/1954 | Innes | 206/626 |
| 3,124,298 | 3/1964 | Repko | 206/449 |
| 3,186,628 | 6/1965 | Rohde | 206/484 |
| 3,215,335 | 11/1965 | Turpin | 229/62 |
| 3,426,959 | 2/1969 | Lemelson | 206/618 |
| 3,439,866 | 4/1969 | Kuhnle | 229/62 |
| 4,252,238 | 2/1981 | Spiegelberg et al. | 206/449 |

FOREIGN PATENT DOCUMENTS

| | | | |
|---|---|---|---|
| 2069456 | 8/1981 | United Kingdom | 229/62 |

*Primary Examiner*—William T. Dixson, Jr.
*Assistant Examiner*—Jimmy G. Foster
*Attorney, Agent, or Firm*—Steven P. Berman

[57] ABSTRACT

A resealable package for premoistened towellettes comprising a sheet of flexible moisture-impermeable material folded about said towellettes and heat sealed to form an inverted T-shaped container enclosing the towellettes within the base of the "T". One of the flaps of the sheet material in the stem of the "T" being provided with a region of weakening spaced from the base of the "T" for opening and dispensing the towellettes.

4 Claims, 5 Drawing Figures

RESEALABLE PACKAGE FOR PREMOISTENED TOWELLETTES

BACKGROUND OF THE INVENTION

A number of different configurations for the packaging of premoistened towellettes have been developed. These packages have exhibited varying degrees of success in maintaining the moisture seal of the package once opened. The packaging developed is typically of two varieties: (1) a larger more permanent package for use at home; and (2)a smaller pack containing only a few towellettes for use on trips or generally when away from home. This application relates to the latter category of packages which are typically constructed of a sheet of flexible moisture-impermeable material comprising a metalized laminate which may be easily heat sealed.

One such package is Scott Baby Fresh Wipes* package which comprises a rectangular pouch having a flap which is resealably attached to the top surface of the pouch by means of adhesive on the pouch. Under the flap is the permanent oval opening in the top surface of the pouch through which the towellettes are dispensed. This opening is initially sealed by a separate, discardable piece of material adhesively attached about the opening. The opening is subsequently "resealed" when the flap is folded thereover and reattached to the adhesive on the top surface of the pouch. This package has a number of disadvantages. The seal of the flap over the opening is not sufficient to substantially retard the evaporation of the premoistened towellettes contained within the package. In addition, the moisture containment of the package upon squeezing is not good. Further, the towellettes remaining within the open pack may be contacted and contaminated through the opening. This pack, as others requiring adhesive for resealability, is easily rendered unusable should the adhesive become non-sticky for any reason or should it be dissolved by the solution used as moistening for the towelletts.

Another package for premoistened towellettes is disclosed in U.S. Pat. No. 4,252,238 assigned to Salve S.A. The Salve package is made from a sheet of flexible moisture-impermeable material folded about a stack of towellettes so as to form an inverted T-shaped container holding the towellettes in the base of the inverted "T". The stem of the "T" comprising two flaps of unequal length which may be folded down to overlie the base of the "T". Preferably the longer flap is initially folded about the edge of the shorter flap resealing the package in a tobacco pouch-like configuration. The initial package seal is created by heat sealing at the juncture of the stem and base of the "T". Such a design requires complicated machinery to make the initial seal and care needs to be taken that the seal is formed such that the initial or primary seal can be easily opened without tearing the package. In addition, the initial seal can be broken accidently upon the manipulation of the package which is anticipated if it is stored in a glove compartment, purse or in a baby diaper bag. Also, the fold of the longer flap about the shorter flap makes the pack more difficult to get into and may interfere with the folding of both flaps down across the body of the package.

When these "portable" packages are manufactured from heat sealable metal laminates, additional difficulties are encountered when the towellette solution contacts a break in the lamiate as such as that created by forming the opening in the package. Often the towellette solution will cause delamination of the metalized layer from the plasticized layer required for heat sealing, presenting an unsightly and potentially dangerous package. In addition, the towellette solution may cause curling of the edges of the opening which may enlarge the opening and reduce moisture retention of the package.

SUMMARY OF THE INVENTION

The present invention comprises a resealable package for premoistened towellettes which has enhanced moisture retention and reduced moisture leakage due to the tougher initial or first seal and to the resealability characteristics of the package. The package also provides improved asepsis and is easier to open and close and may in fact be reopened and relcosed with one hand. The resealable package comprises a sheet of flexible moisture-impermeable material folded about a premoistened towellette to form an inverted T-shaped with the towellettes contained in the base of the inverted "T", and with two end flaps forming the stem of the "T". The folded sheet is heat sealed along its edges and along the end edges at the foot of the stem of the "T" creating a living hinge at the juncture of the stem and the base of the "T". One of the flaps of the sheet material in the stem of the "T" is provided with a region of weakening such as a line of perforation at which an opening may be made in the package and the towellettes dispensed. The initial seal of the package created by the heat seal along the end edges of the flap at the foot of the stem of the "T" creates an area of stiffening which aids in opening and closing the package. This seal is also not easily broken by squeezing or manipulation of the package. The location of the package openig up on the stem of the "T", spaced from the base of the "T" and the towellettes, provides enhanced resealability and better moisture containment upon squeezing, and reduces possibility of contamination of towellettes through the opening. The opening created is easily urged closed by the heat seals along the side and end edges of the package as the flaps of the stem of the "T" are folded down to overlie the base portion of the "T". By omitting a sealing line at the juncture of the stem and the base of the "T", the package can withstand more motion without accidently opening the package and is easier and cheaper to manufacture. The package requires no adhesive for the initial seal or for resealability. For convenience adhesive means may be used to secure the stem of the "T" to the base of the "T" during shipping and to provide easy means of opening at the region of weakening. The packaging may be easily reopened by grasping the stiffened end edge of the flaps of the "T" and pulling, and may be easily resealed in one step by pushing or urging the stem of the "T" towards the body of the "T".

DETAILED DESCRIPTION OF THE DRAWINGS

Figure 1:
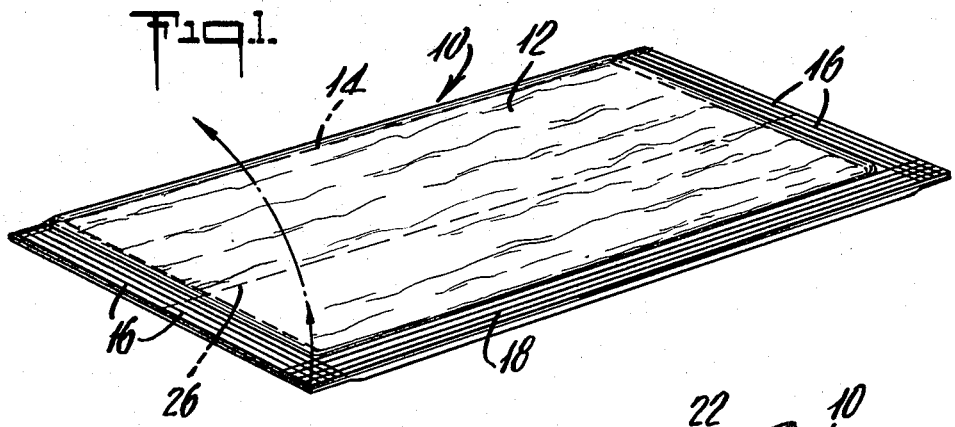
FIG. 1 is a perspective view of the package of the present invention folded flat.

FIG. 1 shows the package 10 of the present invention when folded for shipping or storage. The package comprises a sheet 12 of moisture-impermeable material heat sealed about premoistened towellettes 14.

Figure 2:
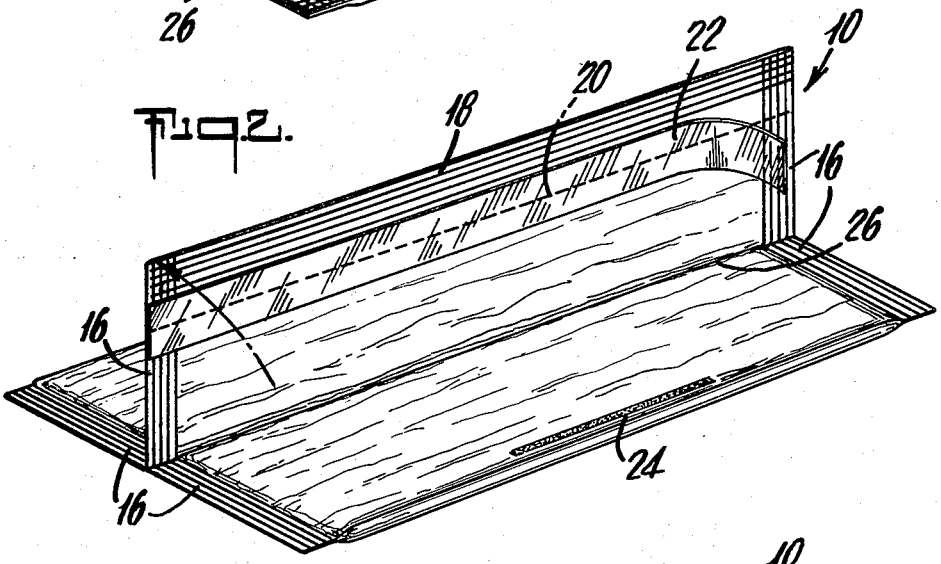
FIG. 2 is a perspective view of a preferred embodiment of the package of the present invention with the end flaps folded up.

As shown in FIG. 2 the package is formed by folding the material about the towellettes and heat sealing the material along the side edges 16 creating a generally inverted T-shaped package containing the towellettes in the base of the "T". The stem of the "T" comprises two end flaps. Another heat seal 18 is formed across the end edges of the flaps of the stem of the "T". The heat seal lines 16 create a living hinge at the juncture of the base and stem of the "T". Heat seal line 18 creates an area of stiffening which aids in the opening and resealing of the package. One flap of the material is provided with a region of weakening 20 on the stem of the "T" at which the package may be opened and the premoistened towellettes dispensed. In a preferred embodiment shown the region of weakening 20 is a line of perforation. In a still preferred embodiment the region of weakening may comprise an adhesive strip 22 overlying a line, a perforation or a slit. Other means of creating a region of weakening are well known to those skilled in the packaging arts. As shown in the preferred embodiment, an adhesive area 24 may also be provided to secure the stem of the "T" to the base or body of the package during shipping and handling, however, it should be noted that the use of adhesive with this package for securing the stem to the base or for use in conjunction with the region of weakening is optional. It should be noted that the package configuration of FIG. 2 may be easily returned to the configuration of FIG. 1 by merely urging the stem of the "T" towards the base of the "T" of the package. The fold line 26 at the juncture of the stem and the base of the inverted "T" is no more than a fold line as no heat seal is created at the juncture.

Figure 3:
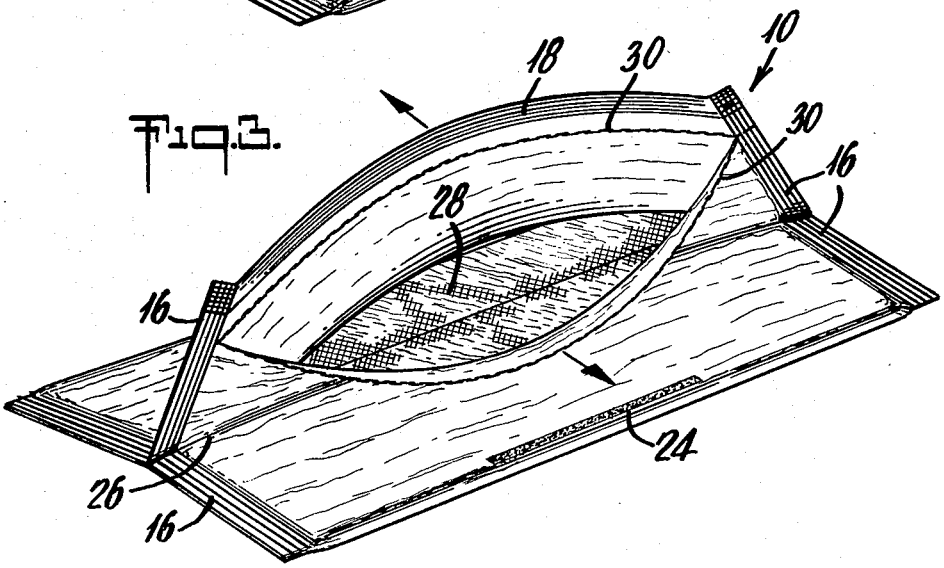
FIG. 3 is a perspective view of a preferred embodiment of the package of the present invention opened for dispensing the towellettes therein.
Figure 4:
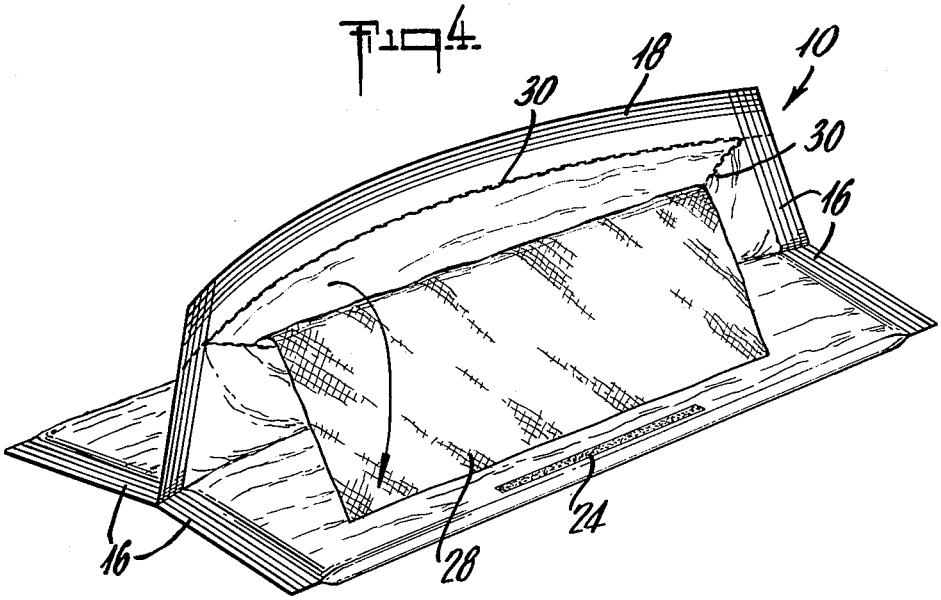
FIG. 4 is a perspective view of the opened package of FIG. 3 with the towellette being dispensed therefrom.

FIG. 3 shows the package of the present invention with the region of weakening opened and the heat seal line 18 pulled away from the base of the "T" exposing the towellettes 28. It should be noted that the opening in the package is spaced from the juncture of the stem and base of the "T" which provides enhanced moisture containment and prevents contamination of the towellettes through the opening in the package. This configuration also minimizes the contact of the edges 30 of the opening with the moistening solution of the towellettes. FIG. 4 shows the package of the present invention with the towellette being dispensed therefrom.

Figure 5:
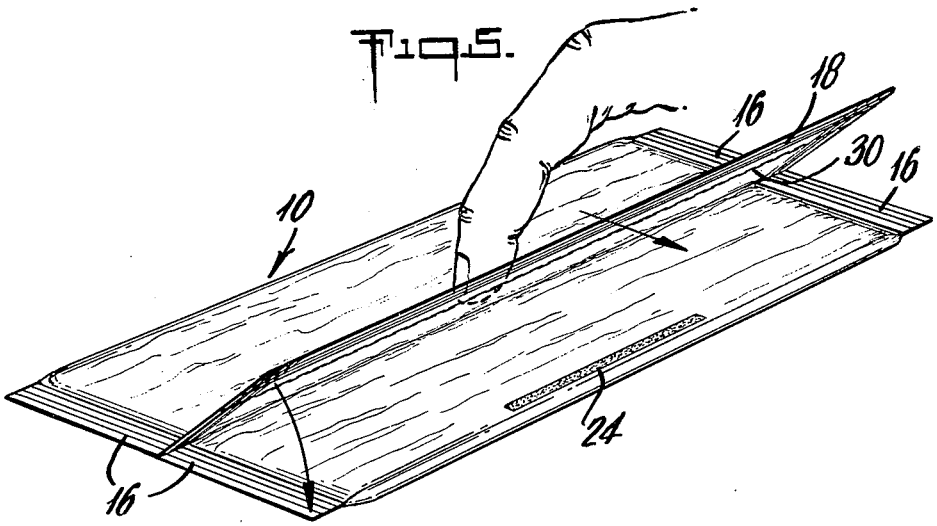
FIG. 5 is a perspective view of a preferred embodiment of the package of the present invention being closed and resealed.

FIG. 5 shows the package of the present invention being closed by urging the heat seal 18 towards the base or body of the package. As shown, the heat seal lines 18 and 16 stiffen the stem of the "T" and align the sheet material at the edges of the opening causing the opening to close as the heat seal 18 is urged toward the base or body of the package. The placement of the opening on one side of the stem created by the end flaps, and at a location spaced from the juncture of the base and stem of the "T" provide a package with enhanced moisture retention and better resealability. In addition the reinforcement of the end flaps along the edges 16 and 18 provide a package which is easier to open and reseal.

The foregoing description of the drawings is illustrative and is not to be taken as limiting, still other variations and modifications are possible without departing from the spirit and scope of the present invention.

I claim:

1. A resealable package for premoistened towellettes comprising a sheet of flexible moisture-impermeable material, said sheet being folded about the towellettes forming an inverted T-shaped package with the towellettes contained within the base of the inverted T-shaped package and having two end flaps forming the stem of the "T", said folded sheet being permanently sealed along its side edges and permanently sealed along the edges of the end flaps, said end flaps being folded flat onto the base of the "T" in the non-dispensing position and one of the end flaps of the sheet material in the stem of the "T" being provided with a region of weakening, spaced from the juncture of the base and stem of the "T", such that the stem may be unfolded to reform the package into the form of an inverted "T" in the dispensing position and an opening may be made in the package at the region of weakening, and the towellettes dispensed therethrough.

2. A resealable package as in claim 1 wherein the flaps of sheet material at the stem of the "T" are initially secured to the base of the "T" by means of adhesive.

3. A resealable package as in claim 1 wherein the region of weakening comprises a line of perforation.

4. A resealable package as in claim 1 wherein the package is made from a metal laminate.

* * * * *